US011254540B2

(12) United States Patent
Shimabayashi

(10) Patent No.: US 11,254,540 B2
(45) Date of Patent: Feb. 22, 2022

(54) MACHINE-ROOM-LESS ELEVATOR

(71) Applicant: Mitsubishi Electric Corporation, Tokyo (JP)

(72) Inventor: Keita Shimabayashi, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 128 days.

(21) Appl. No.: 16/644,170

(22) PCT Filed: Dec. 20, 2017

(86) PCT No.: PCT/JP2017/045810
§ 371 (c)(1),
(2) Date: Mar. 4, 2020

(87) PCT Pub. No.: WO2019/123583
PCT Pub. Date: Jun. 27, 2019

(65) Prior Publication Data

US 2021/0061615 A1 Mar. 4, 2021

(51) Int. Cl.

| | |
|---|---|
| ***B66B 5/04*** | (2006.01) |
| ***B66B 9/00*** | (2006.01) |
| ***B66B 11/00*** | (2006.01) |
| ***B66B 7/02*** | (2006.01) |
| ***B66B 11/04*** | (2006.01) |
| ***B66B 15/02*** | (2006.01) |
| ***B66B 17/12*** | (2006.01) |

(52) U.S. Cl.
CPC ..... *B66B 5/04* (2013.01); *B66B 9/00* (2013.01); *B66B 11/0045* (2013.01); *B66B 7/02* (2013.01); *B66B 11/043* (2013.01); *B66B 15/02* (2013.01); *B66B 17/12* (2013.01)

(58) Field of Classification Search
CPC ..... B66B 11/0045; B66B 17/12; B66B 5/042
See application file for complete search history.

(56) References Cited

U.S. PATENT DOCUMENTS

2013/0220739 A1 8/2013 Okada et al.

FOREIGN PATENT DOCUMENTS

| | | | |
|---|---|---|---|
| CN | 101218163 A | | 7/2008 |
| CN | 103974891 A | | 8/2014 |
| CN | 112299215 A | * | 2/2021 |

(Continued)

OTHER PUBLICATIONS

Machine Translation of CN 101218163 Jul. 2008.*

(Continued)

*Primary Examiner* — Diem M Tran
(74) *Attorney, Agent, or Firm* — Xsensus LLP

(57) ABSTRACT

In a machine-room-less elevator, a hoisting machine is disposed directly above a counterweight. A counterweight speed governor is disposed higher than a position of the counterweight if a car descends to a floor portion of a hoistway and the counterweight jumps upward. When viewed from directly above, at least a portion of the counterweight speed governor is disposed at an identical position to a first counterweight guide rail in a width direction of the counterweight, and is disposed at an identical position to a portion of a suspending body between a driving sheave and a counterweight suspending sheave in a direction that is perpendicular to the width direction of the counterweight.

4 Claims, 3 Drawing Sheets

(56) References Cited

FOREIGN PATENT DOCUMENTS

| | | | | |
|---|---|---|---|---|
| EP | 2338822 | A1 | 6/2011 | |
| JP | 2003-146555 | A | 5/2003 | |
| JP | 2007-062948 | A | 3/2007 | |
| JP | WO2006/008813 | A1 | 5/2008 | |
| JP | 2009-113982 | A | 5/2009 | |
| JP | 2010-208733 | A | 9/2010 | |
| WO | WO-2004022471 | A1 * | 3/2004 | ..... B66B 11/008 |
| WO | 2013/084310 | A1 | 6/2013 | |

OTHER PUBLICATIONS

Office Action dated Feb. 4, 2021, in corresponding Indian patent Application No. 202047022937, 6 pages.
International Search Report and Written Opinion dated Feb. 13, 2018 for PCT/JP2017/045810 filed on Dec. 20, 2017, 8 pages including English Translation of the International Search Report.
Office Action dated Jan. 5, 2021, in corresponding Chinese patent Application No. 201780097620.3, 14 pages.

* cited by examiner

MACHINE-ROOM-LESS ELEVATOR

CROSS-REFERENCE TO RELATED APPLICATION

The present application is based on PCT filing PCT/JP2017/045810, filed Dec. 20, 2017, the entire contents of which are incorporated herein by reference.

TECHNICAL FIELD

The present invention relates to a machine-room-less elevator in which a counterweight speed governor that detects if a speed of a counterweight has reached an overspeed is installed inside a hoistway.

BACKGROUND ART

In conventional elevator systems, a speed governor is disposed between a car and a counterweight when viewed from directly above. The speed governor is disposed at a position that lines up with the counterweight when the counterweight is moved to an uppermost portion (see Patent Literature 1, for example).

CITATION LIST

Patent Literature

[Patent Literature 1]
Japanese Patent Laid-Open No. 2007-62948 (Gazette) (FIGS. 4 and 5)

SUMMARY OF THE INVENTION

Problem to Be Solved By the Invention

In conventional machine-room-less elevators, installation of a counterweight speed governor may be required. A counterweight speed governor is a speed governor that detects if a speed of the counterweight has reached an overspeed. For that purpose, the counterweight speed governor is disposed in a vicinity of the counterweight when viewed from directly above. However, if the speed governor is disposed at a position that lines up with the counterweight when the counterweight is moved to an uppermost portion, as in Patent Literature 1, then it becomes necessary to expand a frontage dimension of a hoistway.

The present invention aims to solve the above problems and an object of the present invention is to provide a machine-room-less elevator that can suppress expansion of planar dimensions of a hoistway by utilizing space inside the hoistway more efficiently to dispose a counterweight speed governor.

Means For Solving the Problem

A machine-room-less elevator according to the present invention includes: a hoisting machine that is disposed in an upper portion inside a hoistway, the hoisting machine including a driving sheave; a suspending body that is wound around the driving sheave; a car that is suspended by the suspending body on a first side of the driving sheave; a counterweight that is suspended by the suspending body on a second side of the driving sheave; first and second counterweight guide rails that are disposed inside the hoistway, the first and second counterweight guide rails guiding ascent and descent of the counterweight; a counterweight suspending sheave that is disposed on the counterweight, the suspending body being wound around the counterweight suspending sheave; and a counterweight speed governor that detects if a speed of the counterweight reaches an overspeed, wherein: the hoisting machine is disposed directly above the counterweight; the first counterweight guide rail is disposed closer to a corner portion of the hoistway than the second counterweight guide rail; the counterweight speed governor is disposed higher than a position of the counterweight if the car descends to a floor portion of the hoistway and the counterweight jumps upward; and when viewed from directly above, at least a portion of the counterweight speed governor is disposed at an identical position to the first counterweight guide rail in a width direction of the counterweight, and is disposed at an identical position to a portion of the suspending body between the driving sheave and the counterweight suspending sheave in a direction that is perpendicular to the width direction of the counterweight.

Effects of the Invention

In the machine-room-less elevator according to the present invention, the counterweight speed governor is disposed higher than a position of the counterweight if the counterweight jumps upward. When viewed from directly above, at least a portion of the counterweight speed governor is disposed at an identical position to the first counterweight guide rail in a width direction of the counterweight, and is disposed at an identical position to a portion of the suspending body between the driving sheave and the counterweight suspending sheave in a direction that is perpendicular to the width direction of the counterweight. Because of that, expansion of the planar dimensions of the hoistway can be suppressed by utilizing space inside the hoistway more efficiently to dispose the counterweight speed governor.

DESCRIPTION OF EMBODIMENTS

A preferred embodiment of the present invention will now be explained with reference to the drawings.

Embodiment 1

Figure 1:
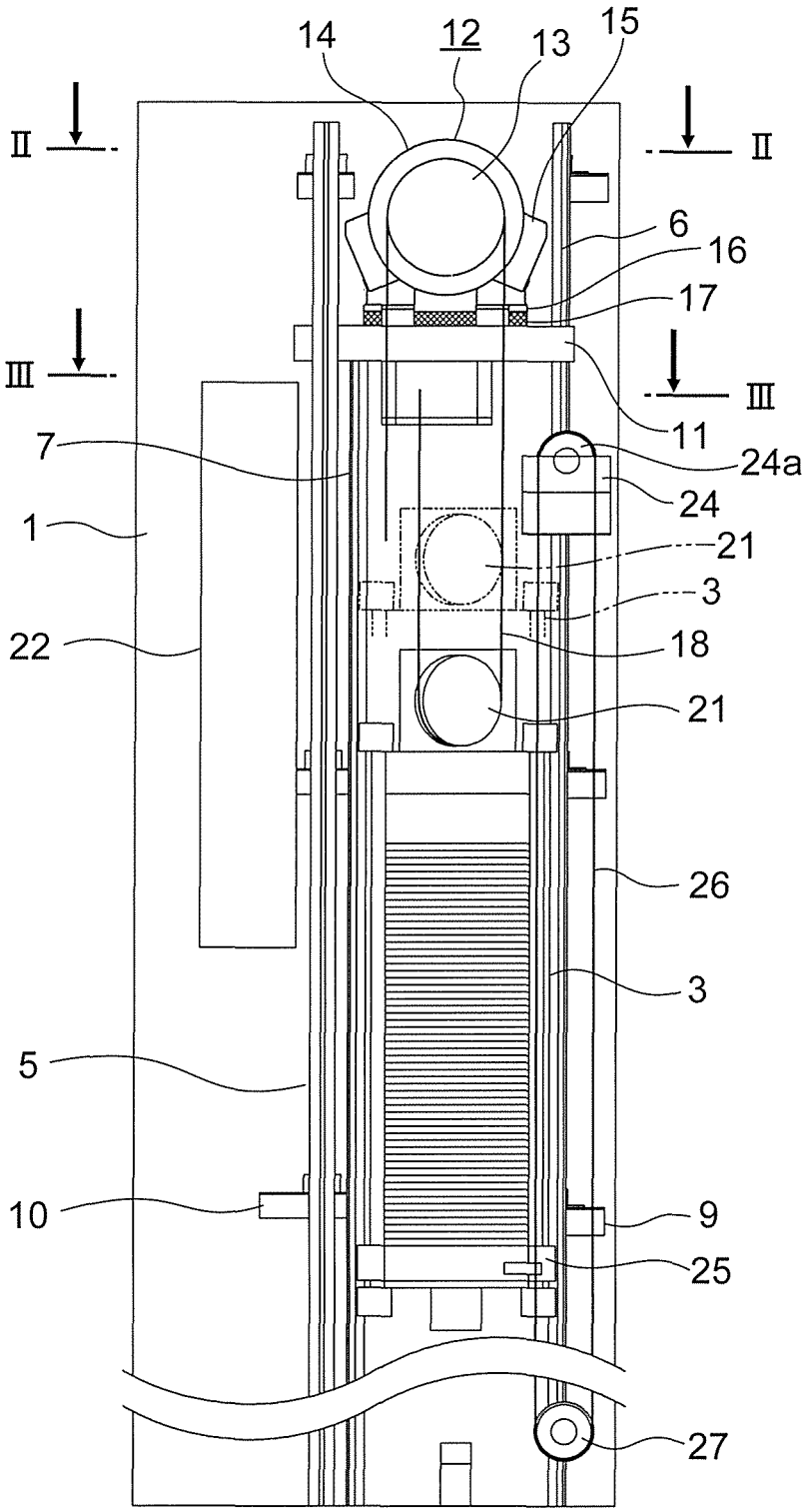
FIG. 1 is a side elevation that shows part of a machine-room-less elevator according to Embodiment 1 of the present invention.
Figure 2:
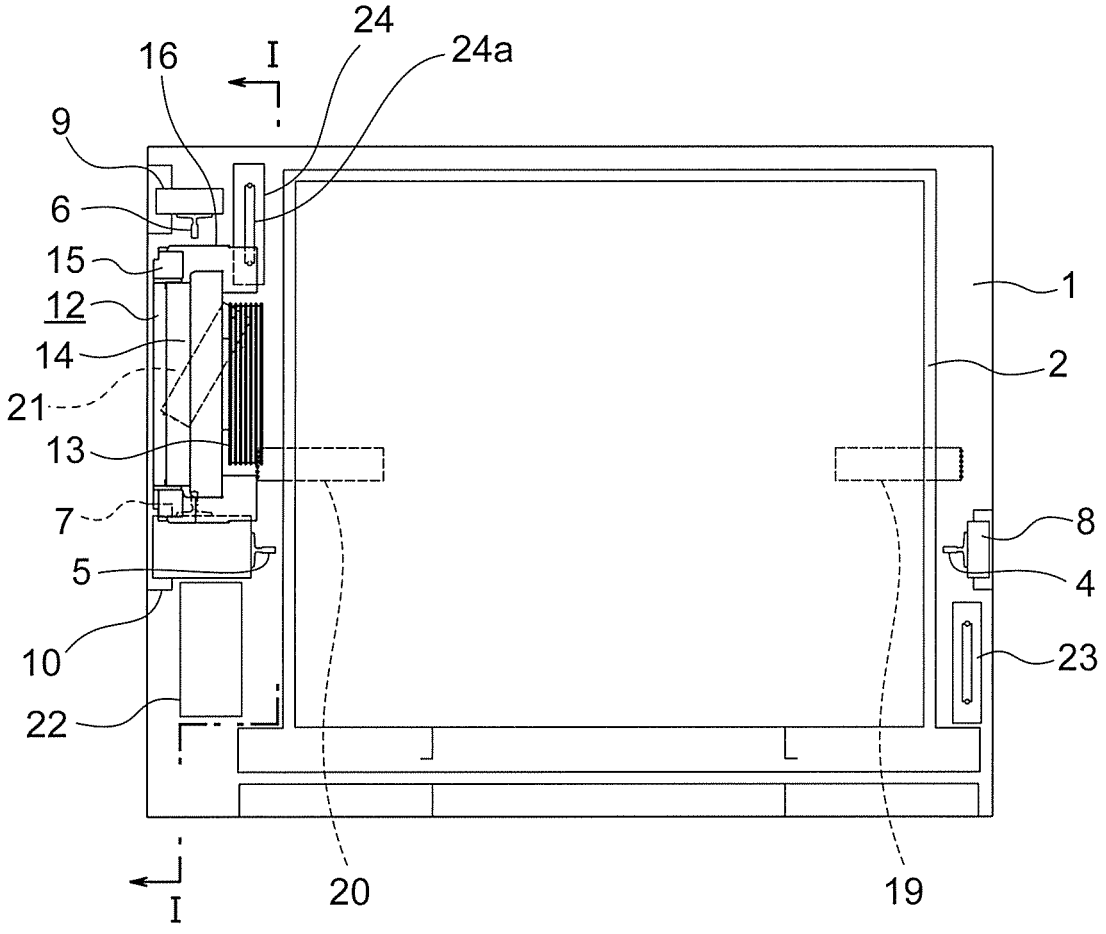
FIG. 2 is a cross section that is taken along Line II-II in FIG. 1.
Figure 3:
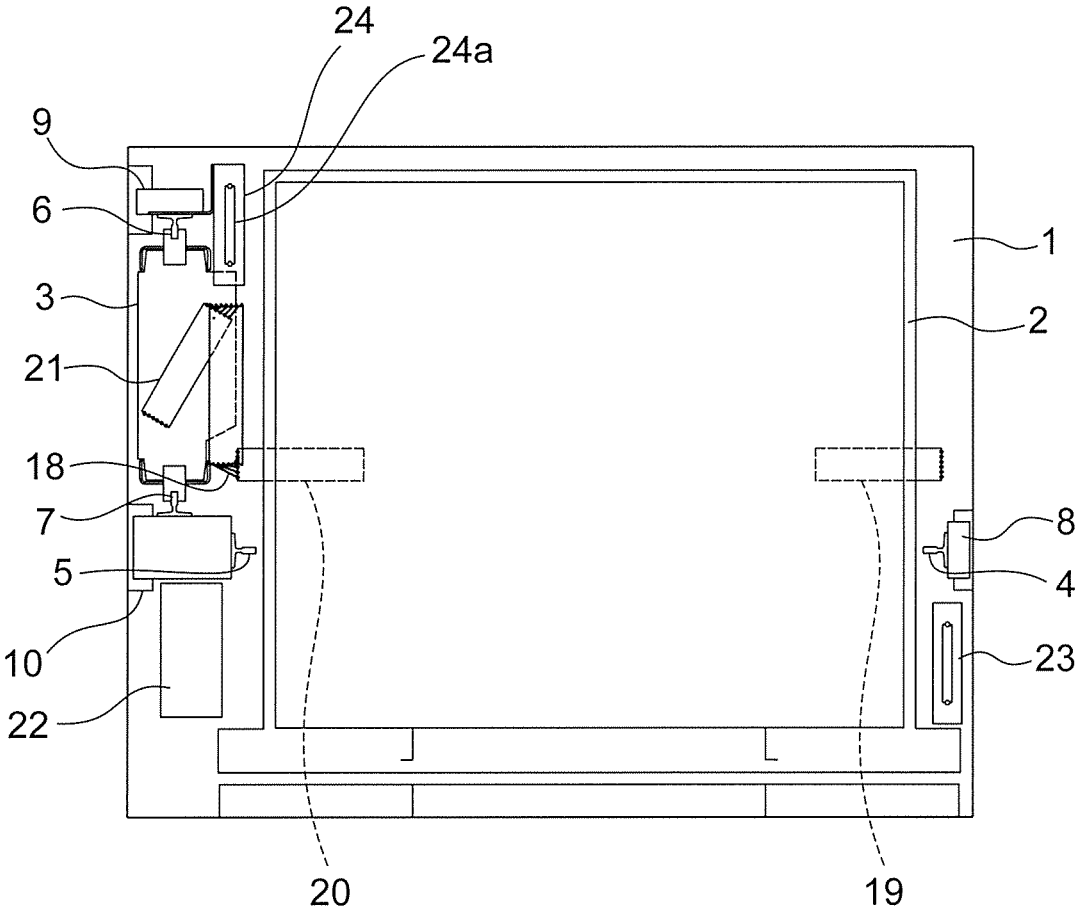
FIG. 3 is a cross section that is taken along Line III-III in FIG. 1.

FIG. 1 is a side elevation that shows part of a machine-room-less elevator according to Embodiment 1 of the present invention. FIG. 2 is a cross section that is taken along Line II-II in FIG. 1. FIG. 3 is a cross section that is taken along Line III-III in FIG. 1. Moreover, FIG. 1 is a view that is taken along line I-I in FIG. 2.

In the figures, a car 2 and a counterweight 3 are disposed inside a hoistway 1. A hoisting zone for the counterweight 3 is disposed beside a hoisting zone for the car 2 when viewed from a landing. A horizontal shape of the counterweight 3 is an oblong.

A first car guide rail 4, a second car guide rail 5, a first counterweight guide rail 6, and a second counterweight guide rail 7 are installed inside the hoistway 1. The first and second car guide rails 4 and 5 guide ascent and descent of the car 2. The first and second counterweight guide rails 6 and 7 guide ascent and descent of the counterweight 3.

The first car guide rail 4 is disposed on an opposite side of the car 2 from the counterweight 3 when viewed from the landing. The second car guide rail 5 is disposed on an identical side of the car 2 to the counterweight 3 when viewed from the landing. The first and second car guide rails 4 and 5 are disposed at identical positions in a depth direction of the car 2.

The first and second counterweight guide rails 6 and 7 are disposed on an identical side to the second car guide rail 5 in the depth direction of the car 2. In this example, the first and second counterweight guide rails 6 and 7 are disposed further rearward than the second car guide rail 5 in the depth direction of the car 2.

The first counterweight guide rail 6 is disposed further rearward than the second counterweight guide rail 7 in the depth direction of the car 2. The first counterweight guide rail 6 is disposed closer to a corner portion of the hoistway 1 than the second counterweight guide rail 7.

The second counterweight guide rail 7 is disposed closer to the second car guide rail 5 than the first counterweight guide rail 6.

A car rail center line, which is a straight line that joins a center of the first car guide rail 4 and a center of the second car guide rail 5, is parallel to a width direction of the car 2 when viewed from directly above. A counterweight rail center line, which is a straight line that joins a center of the first counterweight guide rail 6 and a center of the second counterweight guide rail 7, is perpendicular to the car rail center line when viewed from directly above.

The first counterweight guide rail 6 is disposed on a first side in a width direction of the counterweight 3. The second counterweight guide rail 7 is disposed on a second side in the width direction of the counterweight 3. The width direction of the counterweight 3 is a direction that is parallel to the counterweight rail center line.

The first car guide rail 4 is fixed onto a hoistway wall by means of a plurality of first brackets 8. The first counterweight guide rail 6 is fixed onto a hoistway wall by means of a plurality of second brackets 9. The second car guide rail 5 and the second counterweight guide rail 7 are fixed onto a hoistway wall by means of a plurality of third brackets 10.

A machine base 11 is installed in an upper portion inside the hoistway 1. The machine base 11 is omitted from FIG. 2. The machine base 11 is fixed to the second car guide rail 5 and the first counterweight guide rail 6.

A lower surface of the machine base 11 contacts an upper end surface of the second counterweight guide rail 7. A load on the machine base 11 is thereby supported by the second car guide rail 5, the first counterweight guide rail 6, and the second counterweight guide rail 7.

A hoisting machine 12 is disposed on the machine base 11. The hoisting machine 12 includes a driving sheave 13, a hoisting machine motor 14, a hoisting machine brake 15, and leg portions 16. The hoisting machine motor 14 rotates the driving sheave 13. The hoisting machine brake 15 holds a stationary state of the driving sheave 13. The leg portions 16 are fixed to the machine base 11 so as to have a plurality of buffering members 17 interposed.

A thin type hoisting machine is used as the hoisting machine 12. A thin type hoisting machine is a hoisting machine in which an axial dimension is smaller than a dimension in a direction that is perpendicular to the axial direction. The hoisting machine 12 is disposed directly above the counterweight 3.

The driving sheave 13 is disposed on a side of the hoisting machine motor 14 near the car 2 when viewed from directly above. Rotating shafts of the driving sheave 13 and the hoisting machine motor 14 are disposed horizontally so as to be parallel to the width direction of the car 2.

A suspending body 18 is wound around the driving sheave 13. A plurality of ropes or a plurality of belts are used as the suspending body 18. The car 2 is suspended by the suspending body 18 on a first side of the driving sheave 13. The counterweight 3 is suspended by the suspending body 18 on a second side of the driving sheave 13. The car 2 and the counterweight 3 are raised and lowered inside the hoistway 1 by rotating the driving sheave 13.

The suspending body 18 includes a first end portion and a second end portion. The first end portion is connected to a first rope fastener (not shown). The first rope fastener is supported by the first car guide rail 4 in an upper portion inside the hoistway 1. The second end portion is connected to a second rope fastener (not shown). The second rope fastener is supported by the machine base 11.

A first car suspending sheave 19 and a second car suspending sheave 20 are disposed on a lower portion of the car 2. The first and second car suspending sheaves 19 and 20 are disposed so as to be spaced apart from each other in the width direction of the car 2.

The first car suspending sheave 19 is disposed on a side near the first car guide rail 4 when viewed from the landing. The second car suspending sheave 20 is disposed on a side near the second car guide rail 5 when viewed from the landing.

Rotating shafts of the first and second car suspending sheaves 19 and 20 are disposed horizontally so as to be parallel to the depth direction of the car 2. The first and second car suspending sheaves 19 and 20 are disposed at identical positions in the depth direction of the car 2 so as to be further rearward than the first and second car guide rails 4 and 5.

A counterweight suspending sheave 21 is disposed on an upper portion of the counterweight 3. A rotating shaft of the counterweight suspending sheave 21 is disposed horizontally so as to be inclined relative to the width direction of the counterweight 3.

The suspending body 18 is wound sequentially from the first end portion around the first car suspending sheave 19, the second car suspending sheave 20, the driving sheave 13, and the counterweight suspending sheave 21. In other words, the car 2 and the counterweight 3 are suspended by the suspending body 18 using a two-to-one (2:1) roping method.

A controlling board 22 that controls the hoisting machine 12 is installed in an upper portion inside the hoistway 1. The controlling board 22 is disposed on an identical side of the car 2 as the counterweight 3 when viewed from directly above. The controlling board 22 is disposed further forward in the depth direction of the car 2 than the second car guide rail 5.

A car speed governor 23 and a counterweight speed governor 24 are disposed in an upper portion inside the hoistway 1. The car speed governor 23 detects if a speed of the car 2 has reached an overspeed. The counterweight speed governor 24 detects if a speed of the counterweight 3 has reached an overspeed.

A car safety gear (not shown) is mounted to a lower portion of the car 2. The car safety gear grips the first and second car guide rails 4 and 5 to make the car 2 perform emergency stopping. The car speed governor 23 is connected to the car safety gear by means of a car speed governor rope (not shown). The car speed governor 23 activates the car safety gear if the speed of the car 2 reaches an overspeed.

A counterweight safety gear 25 is mounted to a lower portion of the counterweight 3. The counterweight safety gear grips the first and second counterweight guide rails 6 and 7 to make the counterweight 3 perform emergency stopping.

The car speed governor 23 is disposed between the car 2 and a hoistway wall when viewed from directly above. The car speed governor 23 is disposed on an opposite side of the car 2 from the counterweight 3 when viewed from directly above. The car speed governor 23 is disposed further forward in the depth direction of the car 2 than the first car guide rail 4.

In FIG. 1, positions of the counterweight 3 and the counterweight suspending sheave 21 if the car 2 descends to a floor portion of the hoistway 1 at an estimated maximum speed and the counterweight 3 jumps up are represented by double-dotted chain lines. The counterweight speed governor 24 is disposed higher than the position of the counterweight 3 if the counterweight 3 jumps up. Specifically, the counterweight speed governor 24 is disposed higher than an upper end of a frame body of the counterweight 3 if the counterweight 3 jumps up.

At least a portion of the counterweight speed governor 24 is disposed so as to be level with the counterweight suspending sheave 21 if the counterweight 3 jumps up.

At least a portion of the counterweight speed governor 24 is disposed between the first counterweight guide rail 6 and the car 2 at an identical position to the first counterweight guide rail 6 in the width direction of the counterweight 3, that is, in a vertical direction in FIG. 2, when viewed from directly above.

At least a portion of the counterweight speed governor 24 is disposed at an identical position to a portion of the suspending body 18 between the driving sheave 13 and the counterweight suspending sheave 21 in a direction that is perpendicular to the width direction of the counterweight 3 when viewed from directly above.

The counterweight speed governor 24 is disposed lower than the hoisting machine 12. The hoisting machine 12 overlaps partially with the counterweight speed governor 24 when viewed from directly above. In this example, a leg portion 16 of the hoisting machine 12 overlaps partially with the counterweight speed governor 24, as shown in FIG. 2.

The counterweight speed governor 24 includes a counterweight speed governor sheave 24*a* and a rope catch (not shown). A counterweight speed governor rope 26 is wound around the counterweight speed governor sheave 24*a*.

The counterweight speed governor rope 26 is connected to the counterweight safety gear 25 so as to be installed in a loop inside the hoistway 1. A tensioning sheave 27 is disposed in a lower portion of the hoistway 1. The counterweight speed governor rope 26 is wound around the tensioning sheave 27.

When the counterweight 3 ascends and descends, the counterweight speed governor rope 26 moves cyclically. The counterweight speed governor sheave 24*a* thereby rotates at a rotational speed that corresponds to the traveling velocity of the counterweight 3.

If a descent speed of the counterweight 3 reaches an overspeed, the counterweight speed governor rope 26 is gripped by the rope catch, stopping cycling of the counterweight speed governor rope 26. The counterweight safety gear 25 is thereby activated, and the counterweight 3 performs an emergency stop.

In a machine-room-less elevator of this kind, the counterweight speed governor 24 is disposed higher than the position of the counterweight 3 if the counterweight 3 jumps up. At least a portion of the counterweight speed governor 24 is disposed between the first counterweight guide rail 6 and the car 2 at an identical position to the first counterweight guide rail 6 in the width direction of the counterweight 3, and is disposed at an identical position to a portion of the suspending body 18 between the driving sheave 13 and the counterweight suspending sheave 21 in a direction that is perpendicular to the width direction of the counterweight 3 when viewed from directly above. Because of that, expansion of planar dimensions of the hoistway 1 can be suppressed by utilizing space inside the hoistway 1 more efficiently to dispose the counterweight speed governor 24.

The hoisting machine 12 overlaps partially with the counterweight speed governor 24 when viewed from directly above. Because of that, even if there is no installation space for the counterweight speed governor 24 beside the hoisting machine 12, installation space can be secured.

At least a portion of the counterweight speed governor 24 is disposed so as to be level with the counterweight suspending sheave 21 if the counterweight 3 jumps up. Because of that, the height of the counterweight speed governor 24 can be reduced, improving maintainability.

Moreover, the counterweight 3 may alternatively be disposed further forward than the second car guide rail 5 in the depth direction of the car 2.

The first and second car suspending sheaves 19 and 20 may alternatively be disposed on an upper portion of the car 2.

In addition, the first and second car suspending sheaves 19 and 20 may alternatively be disposed such that the suspending body 18 crosses the bottom or the top of the car 2 obliquely.

Furthermore, the hoisting zone of the counterweight 3 may alternatively be behind the hoisting zone of the car 2 when viewed from the landing.

EXPLANATION OF NUMBERING

1 HOISTWAY; 2 CAR; 3 COUNTERWEIGHT; 6 FIRST COUNTERWEIGHT GUIDE RAIL; 7 SECOND COUNTERWEIGHT GUIDE RAIL; 12 HOISTING MACHINE; 13 DRIVING SHEAVE; 18 SUSPENDING BODY; 21 COUNTERWEIGHT SUSPENDING SHEAVE; 24 COUNTERWEIGHT SPEED GOVERNOR.

The invention claimed is:

1. A machine-room-less elevator comprising:

a hoisting machine that is disposed in an upper portion inside a hoistway, the hoisting machine comprising a driving sheave;

a suspending body that is wound around the driving sheave;

a car that is suspended by the suspending body on a first side of the driving sheave;

a counterweight that is suspended by the suspending body on a second side of the driving sheave;

first and second counterweight guide rails that are disposed inside the hoistway, the first and second counterweight guide rails guiding ascent and descent of the counterweight;

a counterweight suspending sheave that is disposed on the counterweight, the suspending body being wound around the counterweight suspending sheave; and a counterweight speed governor that detects if a speed of the counterweight reaches an overspeed, wherein:

the hoisting machine is disposed directly above the counterweight;

the first counterweight guide rail is disposed closer to a corner portion of the hoistway than the second counterweight guide rail;

the counterweight speed governor is disposed higher than a position of the counterweight if the car descends to a floor portion of the hoistway and the counterweight jumps upward; and when viewed from directly above, at least a portion of the counterweight speed governor is disposed at an identical position to the first counterweight guide rail in a width direction of the counterweight, and is disposed at an identical position to a portion of the suspending body between the driving sheave and the counterweight suspending sheave in a direction that is perpendicular to the width direction of the counterweight.

2. The machine-room-less elevator according to claim 1, wherein:

the counterweight speed governor is disposed lower than the hoisting machine; and the hoisting machine overlaps partially with the counterweight speed governor when viewed from directly above.

3. The machine-room-less elevator according to claim 2, wherein:

the counterweight suspending sheave is disposed on an upper portion of the counterweight; and at least a portion of the counterweight speed governor is disposed so as to be equal in height to the counterweight suspending sheave if the counterweight jumps up.

4. The machine-room-less elevator according to claim 1, wherein:

the counterweight suspending sheave is disposed on an upper portion of the counterweight; and at least a portion of the counterweight speed governor is disposed so as to be equal in height to the counterweight suspending sheave if the counterweight jumps up.

* * * * *